US006409101B1

(12) United States Patent
D'Arrigo

(10) Patent No.: US 6,409,101 B1
(45) Date of Patent: Jun. 25, 2002

(54) HOLLOW OVERSIZED TELESCOPIC NEEDLE WITH ARMATURE

(75) Inventor: Angelo D'Arrigo, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/606,687

(22) Filed: Jun. 30, 2000

(51) Int. Cl.[7] ..... B05B 1/30

(52) U.S. Cl. ..... 239/585.1; 239/585.2; 239/585.3; 239/585.4; 239/585.5

(58) Field of Search ..... 239/585.1, 585.2, 239/585.3, 585.4, 585.5, 586, 584, 581.2, 587.3, 587.4, 575, 590

(56) References Cited

U.S. PATENT DOCUMENTS

| | | | | | |
|---|---|---|---|---|---|
| 4,384,681 | A | * | 5/1983 | Claxton | 239/585.5 |
| 4,944,486 | A | | 7/1990 | Babitzka | |
| 4,946,107 | A | * | 8/1990 | Hunt | 239/585.4 |
| 5,072,885 | A | | 12/1991 | Hans et al. | |
| 5,170,987 | A | | 12/1992 | Krauss et al. | |
| 5,494,223 | A | * | 2/1996 | Hall et al. | 239/585.5 |
| 5,494,225 | A | * | 2/1996 | Nally et al. | 239/585.5 |
| 5,613,640 | A | | 3/1997 | Furuya et al. | |
| 5,820,031 | A | | 10/1998 | Reiter et al. | |
| 5,875,975 | A | | 3/1999 | Reiter et al. | |
| 5,975,436 | A | | 11/1999 | Reiter et al. | |
| 5,992,018 | A | | 11/1999 | Reiter | |
| 6,003,791 | A | * | 12/1999 | Reiter | 239/585.5 |
| 6,045,116 | A | | 4/2000 | Wilke et al. | |

* cited by examiner

*Primary Examiner*—William C. Doerrler
*Assistant Examiner*—Davis Hwu

(57) ABSTRACT

A fuel injector is disclosed. The fuel injector includes a hollow body having an upstream segment and a downstream segment and a valve. The valve has a needle assembly which includes an upstream segment having a first longitudinal channel extending therethrough and a magnetic armature located within the first longitudinal channel. The armature includes a passage extending therethrough. The needle assembly also includes a downstream segment having a second longitudinal channel co-axial with and communicating with the first longitudinal channel. The second longitudinal channel extends through the downstream segment. The needle assembly also includes a seating body located at a downstream end of the downstream segment and a transverse passage located upstream of the seating body. The transverse passage communicates with at least one of the first and the second longitudinal channels. A method of fabricating a needle assembly for a fuel injector is also disclosed.

28 Claims, 4 Drawing Sheets

HOLLOW OVERSIZED TELESCOPIC NEEDLE WITH ARMATURE

FIELD OF THE INVENTION

The present invention relates to armature and needle assemblies for fuel injectors for internal combustion engines.

BACKGROUND OF THE INVENTION

In known fuel injectors, a specific length of needle is required for each particular application. In order to provide a needle for a different application, it is often necessary to design and manufacture a different size needle. Such a requirement is costly and time consuming. It would be beneficial to provide a fuel injector having a needle with a variable length, which can be adjusted to meet the required needle length for the specific application.

Additionally, known fuel injectors presently use a relatively large armature to which the needle is connected. During operation of the fuel injector, a magnetic field generated in the fuel injector reciprocates the armature and the needle to open and close the fuel injector. Such a relatively large armature requires a correspondingly large magnetic force to move the armature. Additionally, the relatively large size of the armature results in a relatively large cost to manufacture the armature. It would be beneficial to provide a smaller, lower cost, armature.

BRIEF SUMMARY OF THE INVENTION

Briefly, the present invention provides a fuel injector comprising a hollow body having an upstream segment and a downstream segment and a valve. The valve has a needle assembly reciprocably mounted in the hollow body. The needle assembly includes an upstream segment having a first longitudinal channel extending therethrough and a magnetic armature located within the first longitudinal channel. The armature includes a passage extending therethrough. The needle assembly also includes a downstream segment having a second longitudinal channel co-axial with and communicating with the first longitudinal channel. The second longitudinal channel extends through the downstream segment. The downstream segment also includes a seating body located at a downstream end and a transverse passage located upstream of the seating body. The transverse passage communicates with at least one of the first and the second longitudinal channels. The valve also includes a seat disposed downstream of the needle assembly. The seating body is adapted to sealingly mate with the seat when the needle assembly is in a closed position.

The present invention also provides a needle assembly for a fuel injector. The needle assembly comprises an upstream segment having a first longitudinal channel extending therethrough and a magnetic armature located within the first longitudinal channel. The armature includes a passage extending therethrough. The needle assembly also includes a downstream segment having a second longitudinal channel co-axial with and communicating with the first longitudinal channel. The second longitudinal channel extending through the downstream segment. The downstream segment also includes a seating body located at a downstream end and a transverse passage located upstream of the seating body. The transverse passage communicates with at least one of the first and the second longitudinal channels.

The present invention also provides a method of fabricating a needle for a fuel injector. The method comprises providing an upstream segment having a first longitudinal channel extending therethrough; providing a downstream segment having a second longitudinal channel extending therethrough, the downstream segment further having a seating surface and a transverse opening extending therethrough upstream from the seating surface; aligning the first longitudinal channel co-axially with the second longitudinal channel; inserting one of the upstream segment and the downstream segment into the other of the upstream segment and the downstream segment; and fixedly connecting the upstream segment and the downstream segment.

BRIEF DESCRIPTION OF THE DRAWINGS

The accompanying drawings, which are incorporated herein, and constitute part of this specification, illustrate the presently preferred embodiments of the invention, and, together with the general description given above and the detailed description given below, serve to explain the features of the invention. In the drawings.

DETAILED DESCRIPTION OF THE PREFERRED EMBODIMENTS

Figure 1:
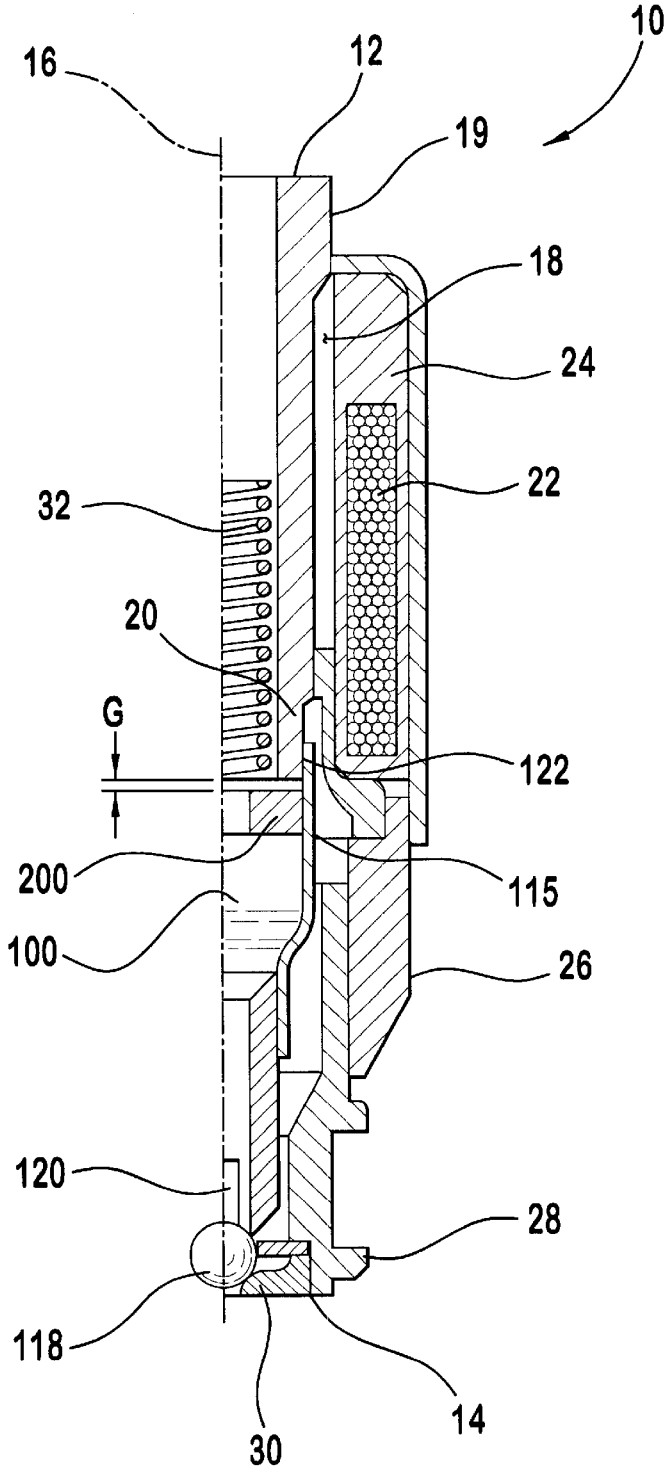
FIG. 1 is a partial side profile view, in section, of a portion of a fuel injector in accordance with a first preferred embodiment of the present invention.

It is well known that fuel injectors can be used to precisely meter fuel for an internal combustion engine. A typical fuel injector incorporates a needle and seat assembly in which the needle reciprocates between an open and closed position. FIG. 1 shows a portion of a fuel injector 10 in which a needle assembly 100 according to any one of the preferred embodiments of the present invention can be used. As used herein, like numbers indicate like elements throughout. The fuel injector 10 has an upstream end 12, a downstream end 14, and a longitudinal axis 16 extending therethrough. A channel 18 extends longitudinally through the fuel injector 10, within a hollow body 19, along the longitudinal axis 16.

The hollow body 19 is generally comprised of a generally cylindrical inlet tube 20 located in the channel 18 and a magnetic core 22 which is surrounded by a plastic overmold 24 and which at least partially surrounds the inlet tube 20. The hollow body 19 also includes a generally cylindrical non-magnetic shell 26, which is located downstream of the overmold 24. As used herein, the term "downstream" is defined to mean a location toward the bottom of the drawing to which is being referred. A generally cylindrical valve body 28 is located downstream of the non-magnetic shell 26. A seat 30 is located inside a downstream end of the valve body 28.

The needle assembly 100 is reciprocably located in the channel 18, downstream of the inlet tube 20. During operation of the fuel injector 10, the needle assembly 100 reciprocably engages and disengages the seat 30, as is well known by those skilled in the art. A biasing element, preferably a helical spring 32, is located in the inlet tube 20 and biases the needle assembly 100 toward the seat 30.

Figure 2:
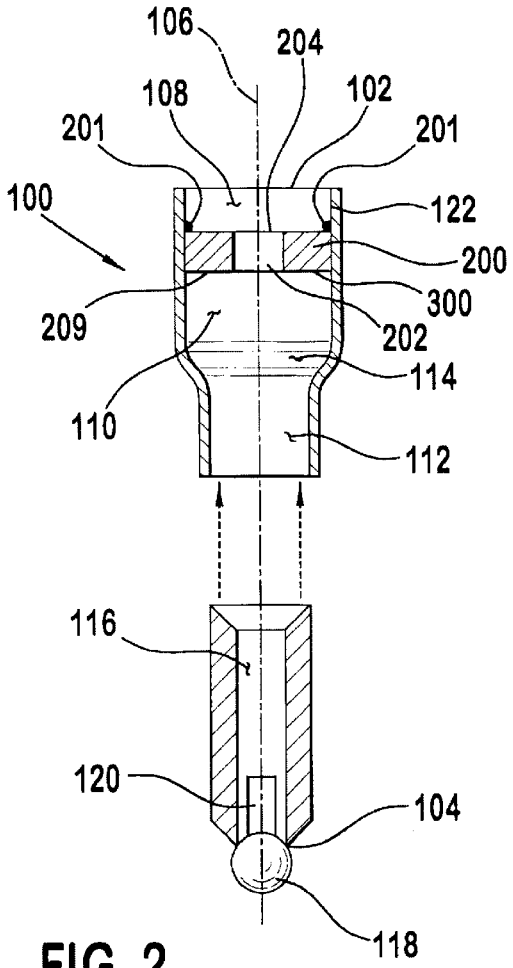
FIG. 2 is a side view, in section of an unassembled needle in accordance with the first preferred embodiment of the present invention.
Figure 3:
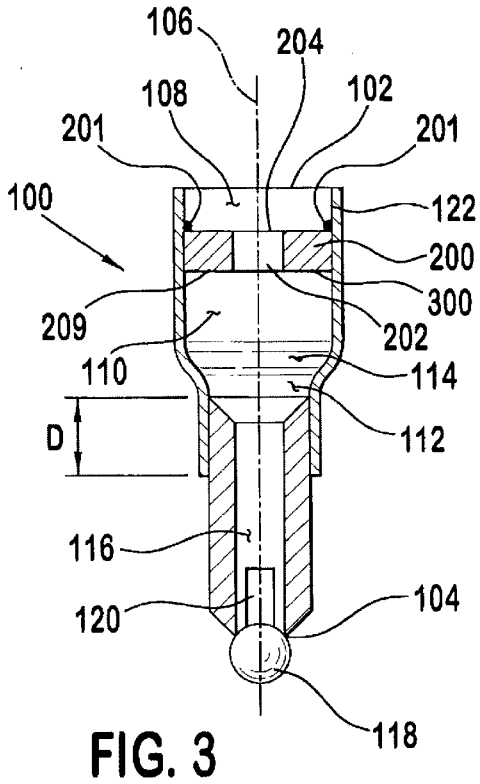
FIG. 3 is a side view, in section, of the needle shown in FIG. 2 having been assembled.

As shown in FIGS. 2 and 3, the needle assembly 100 has an upstream segment 102, a downstream segment 104, and a longitudinal axis 106, which is co-axial with the fuel injector axis 16. The upstream segment 102 and the downstream segment 104 are initially two separate components which are joined together during assembly, as will be described in detail later herein.

The upstream segment 102 includes a first longitudinal channel 108 which extends therethrough along the longitudinal axis 106. Preferably, the first longitudinal channel 108 has an upstream portion 110 and a downstream portion 112, which is narrower than the upstream portion 110. The upstream portion 110 and the downstream portion 112 are connected by an intermediate portion 114, which tapers downward from the upstream portion 110 toward the downstream portion 112.

The downstream segment 104 includes a second longitudinal channel 116 which, when the upstream segment 102 and the downstream segment 104 are connected, as shown in FIG. 3, is co-axial with the first longitudinal channel 108. The outer perimeter of the downstream segment 104 is sized and shaped to fit into the downstream portion of the upstream segment 102 with a slight interference between the upstream and downstream segments 102, 104, respectively. Preferably, the downstream segment 104 is telescopically inserted into the upstream segment 102 a predetermined distance D to obtain a desired overall length of the needle assembly 100. However, those skilled in the art will recognize that the outer perimeter of the upstream segment 102 can be sized and shaped to fit into the upstream portion of the downstream segment 104 so that the upstream segment 102 can be inserted into the downstream segment 104 instead. When the distance D is obtained, the upstream segment 102 and the downstream segment 104 are connected to each other. Preferably, the connection is formed by welding the upstream segment 102 and the downstream segment 104 together, although those skilled in the art will recognize that other methods, including, but not limited to, furnace brazing, swaging, gluing, interference fit or any other known process to join parts can be sued. Those skilled in the art will also recognize that the predetermined distance D is adjustable between different fuel injector designs without the need to manufacture different sized downstream segments 104, providing for economy in manufacturing. Those skilled in the art will also recognize that the upstream segment 102 and the downstream segment 104 can have different wall thicknesses, such as is shown in FIGS. 2 and 3, as required to optimize manufacturing. Additionally, although it is preferred that the downstream segment 104 has a generally circular cross-section, those skilled in the art will recognize that the downstream segment 104 can have other shapes as long as the downstream segment 104 can be telescopically inserted into the upstream segment 102. Any space formed between an interior wall of the upstream end 102 and an exterior wall of the downstream end 104 is permissible, as the space allows fuel to flow from the needle assembly 100 toward the seat 30 for injection into the engine (not shown).

A seating element 118 is fixedly connected to a downstream end of the downstream segment 104 and preferably seals the downstream end of the second longitudinal channel 116. Preferably, the seating element 118 is a generally spherical body, although those skilled in the art will recognize that the seating element can be any other shape, such as a hemisphere, which can seat in the seat 30 when the needle assembly 100 is in the closed position. Also preferably, the seating element 118 is welded to the downstream end of the downstream segment 104. Preferably, the seating element 118 is constructed from a corrosion resistant material, such as stainless steel, although those skilled in the art will recognize that other materials can be used.

Additionally, at least one generally transverse channel 120 is located in the downstream segment 104. Preferably, the transverse channel 120 communicates the second longitudinal channel 116 with an exterior of the downstream segment 104 such, that, during operation of the fuel injector 10, fuel flows downstream through the second longitudinal channel 116, through the at least one transverse channel 120, and out from the needle assembly 100 toward the seat 30 for injection into the engine (not shown). Preferably, the at least one transverse channel 120 is located immediately upstream of the seating element 118, although those skilled in the art will recognize that the at least one transverse channel 120 can be located farther upstream of the seating element 118. Additionally, those skilled in the art will also recognize that the transverse channel 120 can be located in the upstream segment 102, as well.

Preferably, either or both of the upstream segment 102 and the downstream segment 104 can be constructed from a non-magnetic corrosion resistant steel, such as SAE 300 series austenitic. Each of the upstream segment 102 and the downstream segment 104 can be a tube, a longitudinally welded tube, or a tube formed from a rolled thin sheet. Additionally, those skilled in the art will recognize that the upstream segment 102 and the downstream segment 104 can be formed by other methods as well.

A magnetic armature 200, also part of the needle assembly 100, is located within the upstream portion of the first longitudinal channel 108, upstream of the generally transverse channel 120. Preferably, the armature 200 is constructed from a magnetic, corrosion resistant steel, such as 430 FR annealed solenoid quality steel, although those skilled in the art will recognize that other materials can be used instead. The armature 200 includes a central opening or passage 202 therethrough which communicates the first longitudinal channel 108 upstream of the armature 200 with the first longitudinal channel 108 downstream of the armature 200. Preferably, the armature 200 is generally annular, with the passage 202 along the longitudinal axis 106. Alternatively, as shown in FIGS. 4A–4F, armatures 210, 220, 230, 240, 250, 260 can be other than annularly shaped, such as a parallelogram, triangular, splined, polygonal, with openings 212, 224, 234, 244, 254, 264 between the armature 210, 220, 230, 240, 250, 260 and the interior of the upstream segment 102 which defines the first longitudinal channel 108 through which fuel can flow during operation of the fuel injector 10. Preferably, the armature 200 is connected to the interior of the upstream section 102 which forms the first longitudinal channel 108 with a weld 201. However, those skilled in the art will recognize that other methods of permanently fixing the armature 200 in the upstream segment 102 include furnace brazing, swaging, gluing, interference fit, or any other method or process typically used to permanently join the parts.

Preferably, the armature 200 is located downstream in the upstream portion 110 of the first longitudinal channel 108 sufficiently so that a guide portion 122 on the interior of the first longitudinal channel 108 is upstream of the armature 200. Additionally, as shown in FIG. 1, a gap G is formed between the armature 20 and the inlet tube 20, providing a space for the armature 200 and the needle assembly 100 to travel during operation, as will be discussed in more detail later herein. The guide portion 122 reciprocably engages an exterior portion of the inlet tube 20 such that, as the needle assembly 100 assembly reciprocates along the longitudinal axis 106 during operation of the fuel injector 10, the guide portion 122 slides along the exterior portion of the inlet tube 20 and maintains the alignment of the upstream end 102 of the needle assembly 100 with respect to the longitudinal axis 106. The use of the wall of the upstream segment 102 as the guide portion 122 allows for the elimination of a separate upper needle guide which is used in known, prior art fuel injectors.

Also preferably, an upstream face 204 of the armature 200 includes a metal plated surface. Preferably, the metal plated surface is chrome, although those skilled in the art will recognize that other plating metals can be used. Instead of plating, the upstream surface 204 can be surface hardened. The purpose of the metal plating or surface hardening is to provide a hardened upstream surface 204 of the armature 200 so that, when the armature 200 contacts the inlet tube 20 during operation of the fuel injector 10, the armature 200 does not wear. Consequently, the armature 200 is simply an annular disk with a hardened upstream surface 204.

Figure 5:
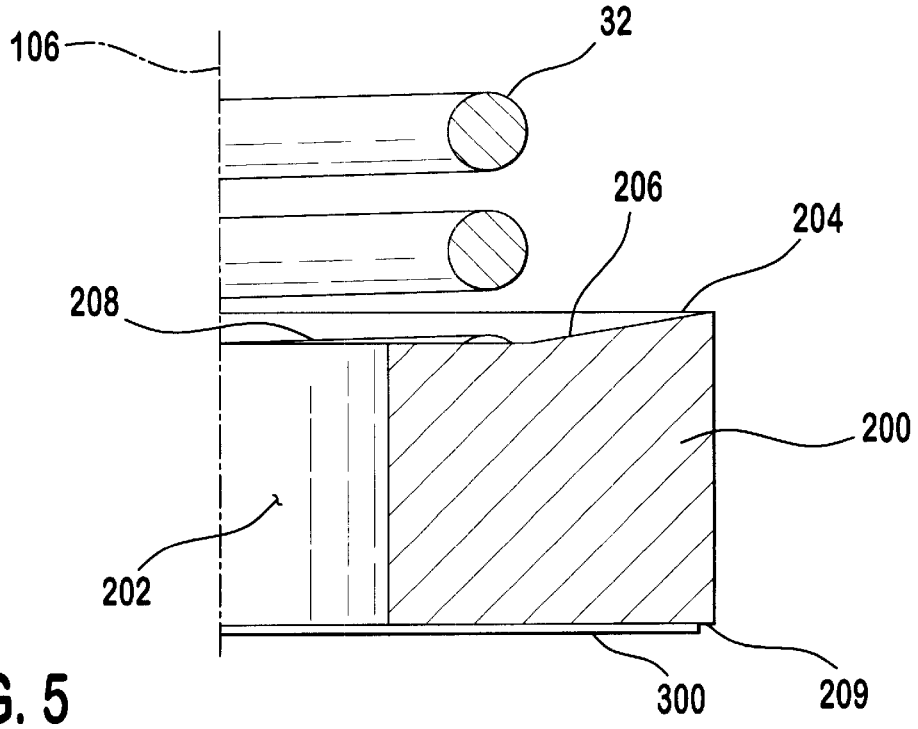
FIG. 5 is an enlarged partial side view, in section, of an armature and spring shown in FIG. 1.

Although the armature 200 may be only a cylinder with a central opening 202, preferably, the upstream surface 204 of the armature 200 may be a generally frusto-conical surface having at least a slight taper 206 toward the longitudinal axis 106, as shown in the enlargement of a portion of the armature 200 and spring 32 in FIG. 5. The tapered portion 206 provides a seating area 208 for the spring 32 to seat on the armature 200. The seating area 208 centers the spring 32 within the inlet tube, reducing the likelihood of contact between the spring 32 and the inlet tube 20 during operation of the fuel injector 10, which can cause wear of the spring 32 and/or the inlet tube 20, resulting in premature failure of the fuel injector 10.

A fuel filter 300 is located in the first longitudinal channel 108, downstream of the armature 200. Preferably, the filter 300 is a flat screen, although those skilled in the art will recognize that other types and shapes of filters, such as conical, can be used. The fuel filter 300 can be connected to a downstream face 209 of the armature 200, such as by welding, and the armature 200 and filter 300 can be installed in the first longitudinal channel 108. Alternatively, the fuel filter 300 can be installed in the first longitudinal channel 108, and then the armature 200 can be installed on top of the filter 300. Those skilled in the art will recognize that the location of the filter 300 in the first longitudinal channel 108, downstream of the armature 200, provides a more efficient filtering capability than known prior art fuel injectors which employ a fuel filter at the upstream end of the injector.

Figure 7:
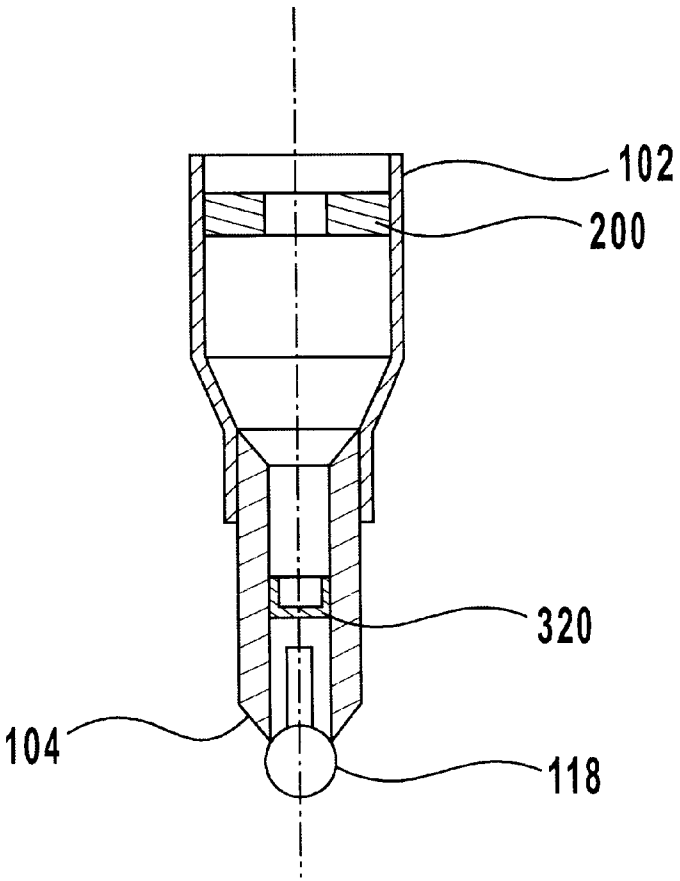
FIG. 7 is a side view, in section, of the needle with the filter in a second alternate location in the needle.
Figure 6:
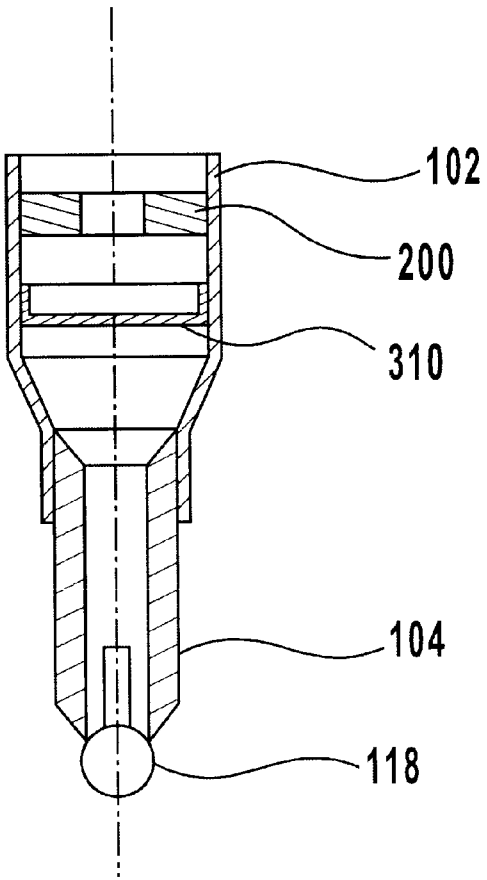
FIG. 6 is a side view, in section, of the needle with a filter in a first alternate location in the needle.

Although it is preferred that the filter 300 is located immediately downstream of the armature 200, those skilled in the art will recognize that a first alternate filter 310 can be spaced from the armature 200, as shown in FIG. 6, or that a second alternate filter 320 can be located in the downstream segment 104, as shown in FIG. 7.

Figure 8:
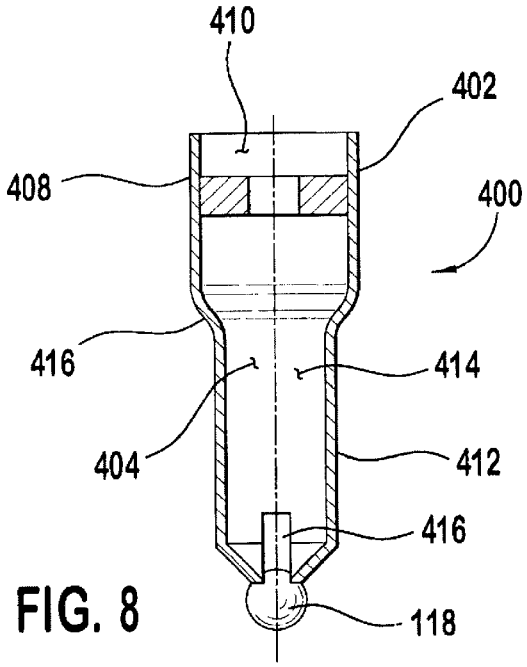
FIG. 8 is a side view, in section of a unitary construction needle in accordance with a second preferred embodiment of the present invention.
Figure 4A:
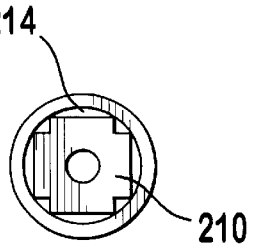
FIGS. 4A–4F show cross-sectional views of alternate embodiments of the armature.
Figure 4B:
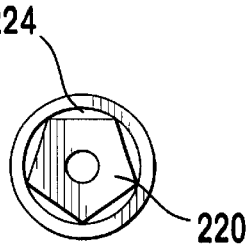
Figure 4C:
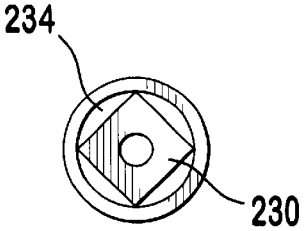
Figure 4D:
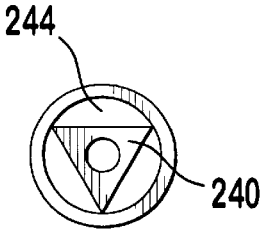
Figure 4E:
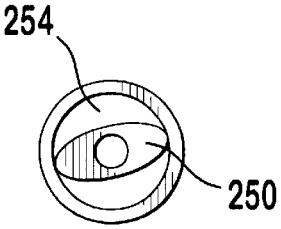
Figure 4F:
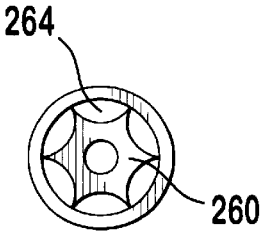

An alternate embodiment of a needle 400 is shown in FIG. 8. The needle 400 is a single, generally cylindrical shell 402 defining a longitudinal channel 404. The shell 402 includes a first, upstream segment 408 having an upstream channel 410 defining a first cross-sectional area and a second, downstream segment 412 having a downstream channel 414 defining a second cross-sectional area, which is smaller than the first cross-sectional area. Preferably, a transitional segment 416 connects the upstream segment 408 and the downstream segment 412, and provides a constantly decreasing cross-sectional channel area between the upstream segment 408 and the downstream segment 412. However, those skilled in the art will recognize that the transitional segment 416 can be omitted and the upstream segment 408 can be directly connected to the downstream segment 412.

The seating element 118 is fixedly connected to a downstream end of the downstream segment 412 and preferably seals the downstream end of the second longitudinal channel 414, similar to the first embodiment, as described above. Preferably, the seating element 118 is welded to the downstream end of the downstream segment 412.

Additionally, at least one transverse channel 416 is located in the downstream segment 412. The transverse channel 416 communicates the downstream channel 414 with an exterior of the downstream segment 412 such that, during operation of the fuel injector 10 fuel flows downstream through the downstream channel 414, through the at least one transverse channel 416, and out from the needle 400 toward the seat 30 for injection into the engine. Preferably, the at least one transverse channel 416 is located immediately upstream of the seating element 118, although those skilled in the art will recognize that the at least one transverse channel 416 can be located farther upstream of the seating element 118.

Preferably, the filter 300 is located immediately downstream of the armature 200, although those skilled in the art will recognize that the filters 310, 320 can be located in the needle 400 as described above in regard to the needle assembly 100.

During operation, the fuel injector is initially in a closed position. The needle assembly 100 is biased downstream by the spring 32, which in turn biases the seating element 118 against the seat 30, sealingly mating the seating element 118 with the seat 30. Fuel is thus precluded from flowing through the injector 10. In the open position, a magnetic coil (not shown) is energized, producing a magnetic force sufficient to overcome the spring 32, drawing the armature 200 upstream, closing the gap G between the armature 200 and the inlet tube 20. Because the armature 200 is fixedly connected to the needle assembly 100, the needle assembly 100 travels upstream with the armature 200, and the seating element 118 is lifted from the seat 30, providing a fluid flow path for the fuel to flow through the injector 10.

The fuel flows downstream from the fuel injector inlet (not shown), through the inlet tube 20 and around the spring 32 to the armature 200. The fuel flows through the central opening 202 in the armature 200 and through any openings between the armature 200 and the needle assembly 100. The fuel then flows through the fuel filter 300 and through the longitudinal channel 108. The fuel then flows through the at least one transverse channel 120 and between the seating element 118 and the seat 30, through the seat 30, and out the downstream end 14 of the injector 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector comprising:

a hollow body having an upstream segment and a downstream segment; and a valve having:

a needle assembly reciprocably mounted in the hollow body, the needle assembly including:

an upstream segment having:

a first longitudinal channel extending therethrough; and a magnetic armature located within the first longitudinal channel, the armature including a passage extending therethrough; and a downstream segment having:

a second longitudinal channel co-axial with and communicating with the first longitudinal channel, the second longitudinal channel extending therethrough;

a seating body located at a downstream end of the downstream segment; and a transverse passage located upstream of the seating body, the transverse passage communicating with at least one of the first and the second longitudinal channels; and a seat disposed downstream of the needle, the seating body being adapted to sealingly mate with the seat when the needle is in a closed position, wherein the downstream segment is connected to the upstream segment with a telescopic connection.

2. The fuel injector according to claim 1, wherein the upstream segment and the downstream segment are nonmagnetic.

3. The fuel injector according to claim 1, further comprising a filter in the first longitudinal channel downstream of the armature.

4. The fuel injector according to claim 1, wherein the telescopic connection is adjustable between the upstream segment and the downstream segment.

5. The fuel injector according to claim 1, wherein the downstream segment is telescopically connected to the upstream segment with an interference fit.

6. The fuel injector according to claim 1, further comprising at least one longitudinal passage formed by the armature and the upstream segment.

7. The fuel injector according to claim 1, wherein the armature further comprises a generally frusto-conical upstream surface tapering downstream toward the first longitudinal channel.

8. The fuel injector according to claim 1, wherein the upstream segment and the downstream segment are of unitary construction.

9. The fuel injector according to claim 1, wherein the upstream segment further comprises an interior guide surface upstream of the armature.

10. The fuel injector according to claim 1, wherein an upstream portion of the first longitudinal channel is sized to accept a portion of an inlet tube therein.

11. The fuel injector according to claim 1 wherein the seating body is a sphere.

12. A needle assembly for a fuel injector comprising:

an upstream segment having:

a first longitudinal channel extending therethrough; and a magnetic armature located within the first longitudinal channel, the armature including a passage extending therethrough; and a downstream segment having:

a second longitudinal channel co-axial with and communicating with the first longitudinal channel, the second longitudinal channel extending therethrough;

a seating body located at a downstream end of the downstream segment; and a transverse passage located upstream of the seating body, the transverse passage communicating with at least one of the first and the second longitudinal channels, wherein the downstream segment is connected to the upstream segment with a telescopic connection.

13. A needle assembly for a fuel injector comprising:

an upstream segment having:

a first longitudinal channel extending therethrough; and a magnetic armature located within the first longitudinal channel, the armature including a passage extending therethrough; and a downstream segment having:

a second longitudinal channel co-axial with and communicating with the first longitudinal channel, the second longitudinal channel extending therethrough;

a seating body located at a downstream end of the downstream segment; and a transverse passage located upstream of the seating body, the transverse passage communicating with at least one of the first and the second longitudinal channels.

14. The needle assembly according to claim 12, further comprising a filter in the first longitudinal channel downstream of the armature.

15. The needle assembly according to claim 12, wherein the telescopic connection is adjustable between the upstream segment and the downstream segment.

16. The needle assembly according to claim 12, wherein the downstream segment is telescopically connected to the upstream segment with an interference fit.

17. The needle assembly according to claim 12, further comprising at least one longitudinal passage formed by the armature and the upstream segment.

18. The needle assembly according to claim 12, wherein the armature further comprises a generally frusto-conical upstream surface tapering downstream toward the first longitudinal channel.

19. The needle assembly according to claim 12, wherein the upstream segment and the downstream segment are of unitary construction.

20. The needle assembly according to claim 12, wherein the upstream segment further comprises an interior guide surface upstream of the armature.

21. The needle assembly according to claim 12, wherein an upstream portion of the first longitudinal channel is sized to accept a portion of an inlet tube therein.

22. The needle assembly according to claim 12, wherein the seating body is a sphere.

23. A method of fabricating a needle assembly for a fuel injector comprising:

providing an upstream segment having a first longitudinal channel extending therethrough;

providing a downstream segment having a second longitudinal channel extending therethrough, the downstream segment further having a seating surface and a transverse opening extending therethrough upstream from the seating surface;

aligning the first longitudinal channel co-axially with the second longitudinal channel;

inserting one of the upstream segment and the downstream segment into the other of the upstream segment and the downstream segment; and fixedly connecting the upstream segment and the downstream segment.

24. The method according to claim 23, further comprising inserting a magnetic armature into the first longitudinal channel.

25. The method according to claim 23, further comprising inserting a filter in the first longitudinal channel.

26. A fuel injector having a housing including an inlet, an outlet, and a passageway for fuel flow from the inlet to the outlet, the fuel injector comprising:

a coil assembly disposed proximate the inlet of the fuel injector;

a seat disposed proximate the outlet of the fuel injector; and a closure member disposed in the housing and operable by the coil assembly to permit and prohibit fuel flow through the seat, the closure member including;

a sleeve extending along a longitudinal axis and having first and second ends, the first end including an inner surface a first distance from the longitudinal axis; and an armature disposed within the first end of the sleeve, the armature having an outer perimeter a second distance from the longitudinal axis, the second distance not greater than the first distance.

27. The fuel injector of claim 26, wherein the closure member comprises a spherical body.

28. A fuel injector having a housing including an inlet, an outlet, and a passageway for fuel flow from the inlet to the outlet, the fuel injector comprising:

a coil assembly disposed proximate the inlet of the fuel injector;

a seat disposed proximate the outlet of the fuel injector; and a closure member disposed in the housing and operable by the coil assembly to permit and prohibit fuel flow through the seat, the closure member including;

a sleeve extending along a longitudinal axis and having first and second ends, the first end including an inner surface a first distance from the longitudinal axis; and an armature disposed within the first end of the sleeve, the armature having an outer perimeter a second distance from the longitudinal axis, the second distance not greater than the first distance, wherein the first end of the sleeve comprises a first tube and the second end of the sleeve comprises a second tube coupled to the first tube.

* * * * *